United States Patent [19]

Durkan, Jr.

[11] Patent Number: 4,749,101

[45] Date of Patent: Jun. 7, 1988

[54] HINGE ASSEMBLY FOR LIDDED REFUSE CONTAINERS

[76] Inventor: Martin J. Durkan, Jr., 3000 Lind Ave. SW., Renton, Wash. 98055

[21] Appl. No.: 62,486

[22] Filed: Jun. 15, 1987

[51] Int. Cl.[4] ..... B65D 43/14; B65D 51/04

[52] U.S. Cl. ..... 220/337; 220/1 T; 280/47.17

[58] Field of Search ..... 220/1 T, 337, 343; 280/47.17, 47.26

[56] References Cited

U.S. PATENT DOCUMENTS

| | | | |
|---|---|---|---|
| 4,401,312 | 8/1983 | Parker | 280/47.17 |
| 4,450,976 | 5/1984 | Snyder et al. | 220/343 |
| 4,558,799 | 12/1985 | Hammond | 220/343 |
| 4,663,803 | 5/1987 | Gora | 220/337 |

OTHER PUBLICATIONS

Durable Technology Inc. brochure entitled "Introducing the New and Proven Way of Automated Refuse Collection" (undated).

Durable Technology Inc. brochure entitled "Introducing the New and Proven Way of Residential Trash Collection" (undated).

Durable Technology Inc. brochure entitled "'DURA--KAN' Means 'DURABILITY'" (undated).

The Heil Co., Drawing No. 701c 6523, (Jun. 1982).

Dye Plastics Corp. Drawing No. DP 5020, entitled "90 Gal Disposal Can" and dated Jan. 24, 1983.

*Primary Examiner*—George T. Hall

*Attorney, Agent, or Firm*—Graybeal, Jensen & Puntigam

[57] ABSTRACT

A refuse container having a hinged lid pivotally supported on the ends of a transverse handle of the container body. The lid is pivotally supported on the handle by two arms extending laterally from the lid and having inwardly facing sockets. Two pins extending outwardly from respective ends of the handle interfit within the sockets of the lid's arms. Proximal portions of the pins are frustoconical, and the sockets are correspondingly widened at their openings. Installation and removal of the lid are accomplished simply by flexure of the lid to increase the distance between the sockets of the lid arms. The container is well suited for use with fully automated, semi-automated, and manual refuse collection systems.

13 Claims, 2 Drawing Sheets

HINGE ASSEMBLY FOR LIDDED REFUSE CONTAINERS

BACKGROUND OF THE INVENTION

1. Technical Field

This invention relates to refuse containers and the like, and more particularly to hinged assemblies for the lids of such containers.

2. Description of the Prior Art

Refuse collection is becoming increasingly mechanized. As little as ten years ago, laborers hoisted to their shoulders heavy steel cans filled with garbage and carried the containers to, and emptied the contents into, a truck parked at the curbside. This essentially manual system for transferring refuse from the customers' containers to the collection truck has rapidly become uneconomical in nations having rising wage rates and falling costs of automation.

Automated refuse collection systems are improving the efficiency of refuse collection and reducing the need for highly paid manual refuse collectors. In both semi-automated and fully automated refuse collection systems the entire customer base is provided with identical refuse containers, and the collection trucks are equipped with lifting mechanisms for automatically emptying such containers.

In a semi-automated refuse collection system, the filled refuse containers are manually positioned on the lifting mechanism on the truck. Known semi-automated containers are substantially rectangular, with a lifting receptacle located in the front vertical wall of the container. The lifting mechanism engages and locks into the lifting receptacle of a container, and lifts the container until it is inverted over and emptied into the receiving hopper of the truck. The container is then lowered and manually disengaged from the lifting mechanism, and manually returned to its original place.

Fully automated refuse collection systems eliminate the need for manual positioning of the containers adjacent the truck. A fully automated collection truck is equipped with a robotic-type manipulator disposed at the end of an articulated mechanical arm. Customers are required to place their containers at or near the curbside, where they can be reached by the manipulator. With the truck stopped near a container, the driver operates the arm and manipulator to securely grasp the container and lift and empty it into the truck, and then replaces the continer at the curbside. Fully automated collection systems require only one worker per truck, in contrast to the driver plus multiple laborers required by both manual and semi-automated systems.

Both semi-automated and fully automated refuse collection systems require that the containers used therein have hinged lids which can be readily opened when the container is emptied into the truck, and equally readily replaced to cover the empty container. In addition to a hinged lid, a semi-automated or fully automated refuse container is typically also provided with one or more wheels at the base of the container, and a horizontal handle along an upper edge of the container. By grasping the handle and tilting the container, customers can roll the container on its wheels to the curbside. For simplicity of manufacturing and assembly, it is advantageous to mount the hinged lid to pivot around the axis of the horizontal handle. Snyder et al U.S. Pat. No. 4,450,976 discloses a wheeled molded container with a hinged lid in which the hinge rod joining the container body and lid is partially exposed to function as a handle. The Snyder et al hinge rod extends through interconnected hinge portions of the container and the lid, pivotally coupling the container and lid. The hinge rod is exposed in regions between the interconnected hinge portions so that the rod can be grasped and function as a handle for manipulating the container. The Snyder et al container requires careful and accurate alignment during assembly. After molding, aligned apertures are bored through the hinge portions of the lid and container, and the hinge rod is then passed through the apertures and capped. Such alignment, boring and assembly necessarily increases the cost of producing the Snyder et al container.

Rotational molding techniques, when applied to thermoplastics such as high density, cross-linkable polyethylene or other polyolefins, allow production of plastic objects having substantially uniform wall thicknesses. Rotational molding involves rotating about at least two axes a heated mold containing a quantity of a thermoplastic. The multiaxial rotation spreads the melted plastic uniformly over the surface of the mold. Subsequent cooling of the mold solidifies the plastic against the mold, producing a solid plastic object. Rotationally molded plastic is both strong and durable. Further, rotationally molded plastic objects can include additional desirable features such as fire retardant additives, colors on request, or custom designs molded into the object. Rotational molding is a known method of producing strong, durable, attractive, and relatively lightweight refuse containers usable with semi-automated and fully automated refuse collection systems.

SUMMARY OF THE INVENTION

It is therefore an object of the present invention to provide a refuse container having a hinged lid which is pivotally mounted on the container's handle and which is readily attachable to and removable from the handle.

It is another object of this invention to provide a refuse container and hinged lid which may be readily manufactured using conventional rotational plastic molding techniques.

These and other objects are provided by a refuse container having a container body, a handle, and a lid, all of which are formed using rotational molding. The handle is affixed to the container body parallel to and spaced apart from an upper edge of the container body. The lid is pivotally supportable on the ends of the handle by a hinge. The hinge comprises two arms extending laterally from the lid and two pins extending transversely outwardly from respective ends of the handle. When the pins of the handle are positioned in corresponding sockets of the lids arms, the lid is thereby pivotally supported on the ends of the handle. The laterally extending arms are transversely separated by a distance substantially equal to the distance between the ends of the handle.

Other features and advantages of the present invention will become apparent from the following detailed description of a typical embodiment thereof, taken in conjunction with the accompanying drawings.

DESCRIPTION OF THE PREFERRED EMBODIMENT

Figure 1:
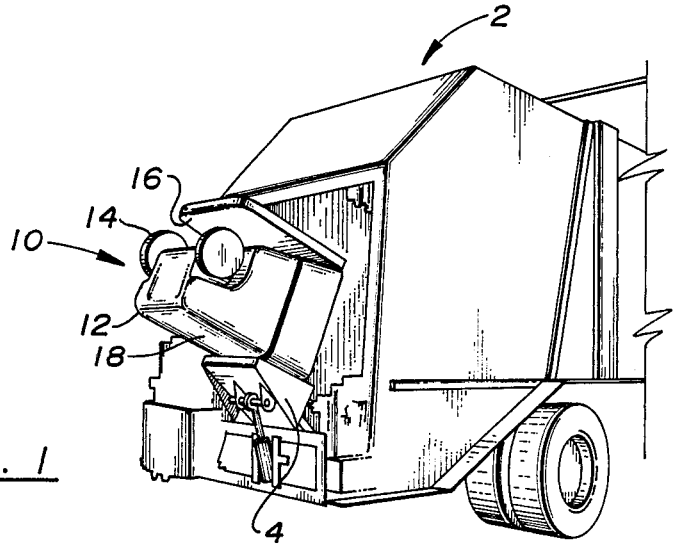
FIG. 1 is an isometric view of the operation of a substantially rectangular semi-automated refuse collection container being inverted and emptied into a collection truck having a semi-automated lifting device.
Figure 2:
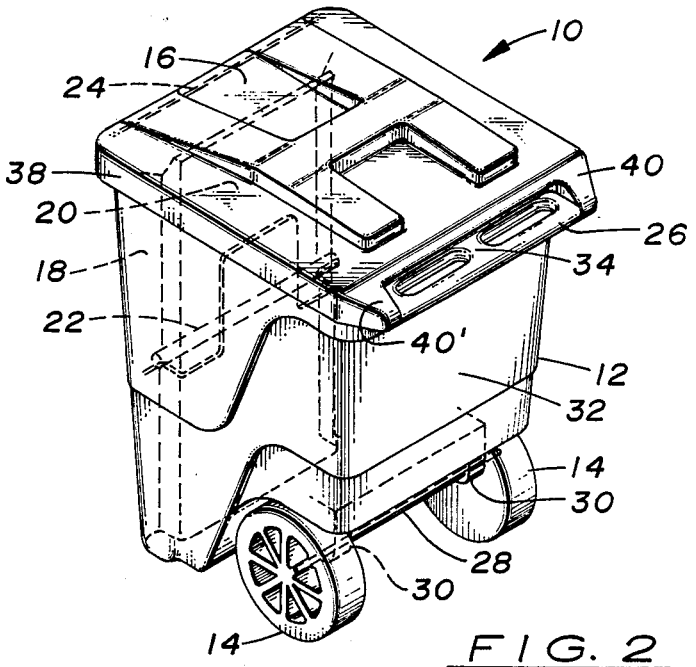
FIG. 2 is an isometric view of the refuse container of FIG. 1, showing the handle and the lid pivotally mounted thereon.

FIG. 1 shows a refuse container 10 according to the present invention being emptied by a semi-automated refuse collection truck 2. Although the following description is directed toward a semi-automated refuse container, it will be understood that the present invention is equally well adapted to use with a fully automated or a manual collection system.

The refuse container 10 comprises a container body 12, wheels 14 at a lower end of the container body, and a hinged lid 16. The container body 12 is a substantially rectangular, inverted frusto-pyramidal element. A front wall 18 of the container body 12 includes means for receiving the lifting mechanism 4 of the collection truck 2 so that the container 10 may be lifted and emptied into the truck. In particular, a central vertical portion of the front wall 18 is recessed inwardly to create a center channel 20 extending vertically from the lower edge of the front wall 18.

A lift bar 22 is securely mounted transversely across the recessed center channel 20 of the container body 12. The lift bar 22 is a metal rod spaced between the surface of the recessed center channel 20 and the remaining flanking portions of the front wall 18. The lift bar 22 is securely held in holes formed through the narrow, laterally oriented vertical portions of the front wall 18 forming the edge walls of the recessed channel 20. The lift bar 22 is emplaced and removed by flexing outwardly the front wall 18 of the container body 12. A lip 24 extends downwardly from the upper edge of the front wall 18 to cover an uppermost portion of the recessed outer channel 20, forming an inverted pocket at the upper end of the channel. The recessed channel 20, the lift bar 22, and the pocket behind the lip 24 comprise the means for receiving the lifting mechanism 4 of the collection truck 2.

The refuse container 10 is provided with wheels 14 and a handle 26 to facilitate the consumer's moving the container even when it is heavily filled. The wheels 14 suitably are rubber tired metal wheels fixedly attached to opposite ends of a metal axle 28. The axle 28 is journaled through bosses 30 which extend laterally and downwardly from a lower, laterally rearwardly portion of the container body 12. The bosses 30 are transversely spaced apart to securely and stably mount the container body 12 on the axle 28. The axle 28 is journaled directly through the bosses 30 without a separate bushing, since the petroleum-based polyethylene or the like from which the container 10 is rotationally molded is inherently self-lubricating.

The handle 26 allows the consumer to conveniently move the container even when heavily loaded by grasping the handle and tilting the container until it can be rolled on the wheels 14. The handle is oriented transversely, parallel to an upper edge of a rear wall 32 of the container body 12. The handle 26 is a substantially tubular member spaced laterally from the upper edge of the rear wall 32 to allow the consumer to securely grasp the handle by extending his or her fingers through the gap between the handle and the rear wall. The handle 26 is joined to the container body 12 by handle supports 34 integrally molded therebetween.

Figure 3:
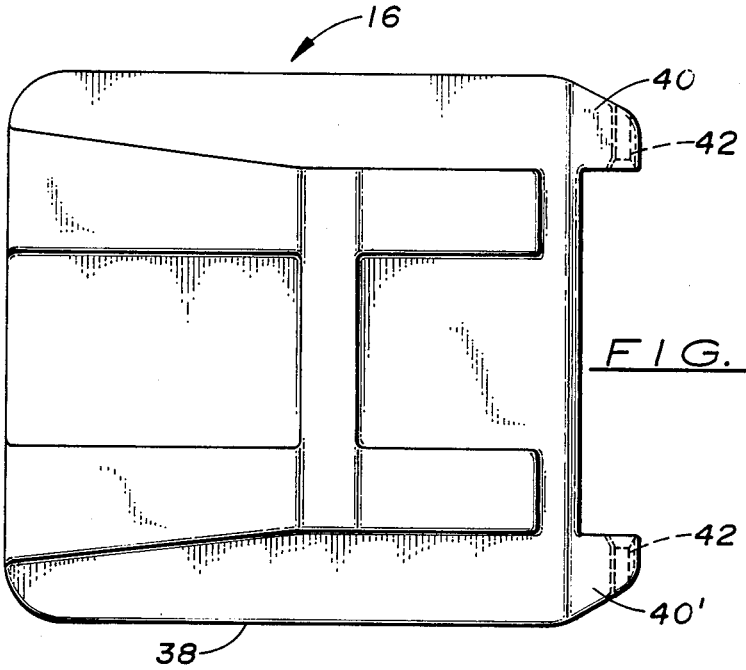
FIG. 3 is a top plan view of the lid of FIG. 2, showing the laterally extending arms and sockets therein.

The container 10 of the present invention includes means for pivotally mounting the lid 16 on pins 36, 36' extending outwardly at the ends of the handle 26. Referring now to FIG. 3, the lid 16 is a substantially rectangular object for covering the open upper end of the container body 12. The lid 16 includes a depending peripheral skirt 38 which is configured to surround an upper portion of the container body 12 when the lid is closed. The lid 16 also includes a molded logo or other identifying design in the center of the lid. The lid 16 is ribbed to strengthen and decorate it.

The lid 16 is pivotally mounted on the pins 36, 36' extending outwardly from the handle 26 by two arms 40, 40' which extend laterally rearwardly from the lid. Transversely outboard portions of the arms 40, 40' are joined to the skirt 38 to form a smooth continuous vertical surface. Transversely inboard portions of the arms 40, 40' are nominally separated by a distance substantially equal to the distance between the ends of the handle 26, i.e. substantially equal to the length of the handle 26. A socket 42 is formed in the inboard portion of each arm 40, 40'. The sockets 42 of the arms 40, 40' receive the respective interfitting pins 36, 36' to pivotally mount the lid 16 on the ends of the handle 26.

Figure 4:
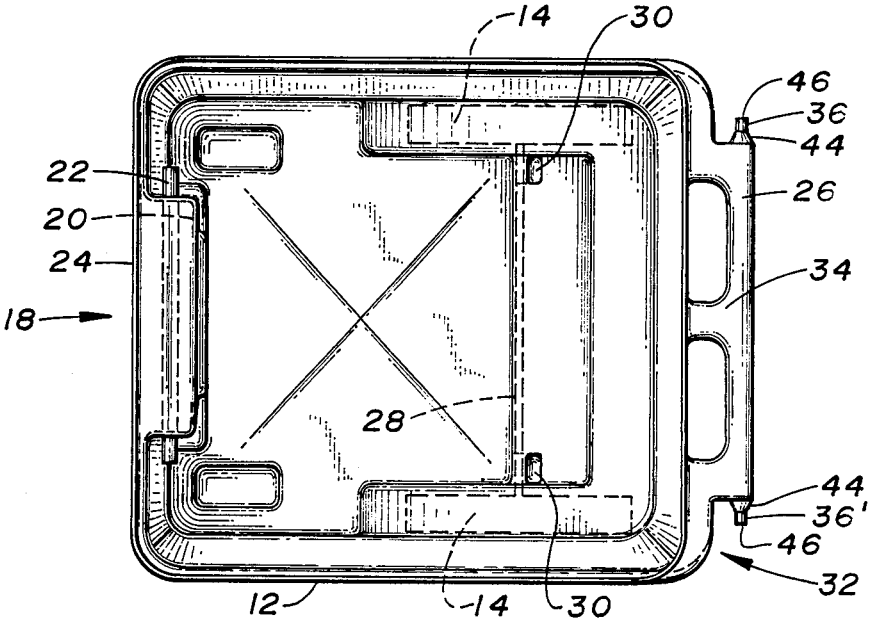
FIG. 4 is a top plan view of the body of the container of FIGS. 1 and 2, showing the transversely extending handle and the transversely extending pins at the ends of the handle.

As seen in FIG. 4, the pins 36, 36' include frustoconical proximal portions 44 affixed to the handle 26 and tapering therefrom toward thinner cylindrical distal portions 46. The sockets 42, 42' are suitably shaped to receive the pins 36, 36' and therefore include correspondingly frustocontical openings tapering inwardly to a narrower diameter. The diameter of the distal portion 46 of each pin is suitably about one-half the diameter of the base of the frustoconical proximal portion 44 of the pin, and the angle subtended by the sloping sides of the frustoconical proximal portion is about 50°.

One of the major advantages of the present invention is that the lid 16 is flexibly mountable on and removable from the ends of the handle 26. By the nature of the polyethylene or the like from which it is rotationally molded, the lid 16 is inherently flexible to a degree, allowing the lid 16 to be flexibly mounted and removed substantially as follows. A selected first arm 40 of the lid 16 is positioned with its socket 42 receiving corresponding pin 36. The opposite arm 40' of the lid 16 is positioned with the socket 42 thereof immediately above its corresponding opposite pin 36'. The lid 16 is then flexed so that the socket 42 of the second arm 40' is moved out of alignment with the socket of the first arm 40, and the distance between the transversely inboard surfaces of the arms 40, 40' increased sufficiently to allow the inboard surface of the second arm 40' to clear the adjacent pin 36'. While flexed, the lid 16 is then moved so that the second arm 40' is positioned with the socket 42 thereof aligned with its corresponding pin 36'. Finally, the lid 16 is unflexed and allowed to return to its original shape, with the second arm 40' abutting the adjacent end of the handle 26, and with the pin 36' of said end of the handle snugly received within the socket 42 of the second arm 40'. Thus in place, the lid 16 can be easily pivoted around the hinge axis defined by the pins 36, 36' of the handle 26.

Except for the wheels 14, axle 28, and bar 20, the container and lid are formed entirely of rotationally molded high density plastic, with a substantially uniform wall thickness throughout, suitably ¼", for example.

It will be appreciated that although a specific embodiment of the invention is described herein for purposes of illustration, various modifications may be made without departing from the spirit and scope of the invention. Accordingly, the scope of the invention is not limited except as by the following claims.

I claim:

1. In a refuse container having a container body, a handle affixed to the container body and positioned parallel to and spaced apart from an upper edge of the container body, and a lid supportable on the handle, the container body, the handle and the lid being molded from plastic, the improvement comprising:

two pins extending transversely outwardly from respective ends of the handle, each of said pins having a substantially frustoconical proximal portion; and two arms extending laterally from the lid, the arms being transversely separated by a distance substantially equal to the distance between the ends of the handle, each arm including a socket for receiving a corresponding end of the handle;

wherein the lid is pivotably supported on the ends of the handle when the pins of the handle are positioned in their corresponding sockets.

2. A hinge according to claim 1, wherein the pins have a smaller diameter than the handle.

3. A hinge according to claim 1, wherein the lid is removably and mountably supported on the handle ends.

4. A hinge according to claim 3, wherein the lid is flexibly removable from and mountable on the handle ends.

5. A hinge according to claim 1, wherein the container body and the handle comprise an integrally molded structure, and the lid and the arms comprise a separate integrally molded structure.

6. A hinge according to claim 1, wherein the lid includes a depending peripheral skirt configured to surround an upper portion of the container body when the lid is closed, said skirt being joined at its ends to transversely outboard portions of the arms.

7. A refuse container comprising:

a container body having a horizontal handle extending substantially continuously between transversely opposed ends, and two pins extending transversely outwardly from respective ends of the handle, each of said pins having a substantially frustoconical proximal portion tapering away from the end of the handle, the container body and handle being being molded as an integral component from plastic; and a lid having two laterally extending arms transversely separated by a distance substantially equal to the distance between the ends of the handle, each arm having a transversely inwardly opening socket for receiving a corresponding pin of the handle, the lid and arm being molded as a separate integral component from plastic;

wherein the lid is pivotably supported on the ends of the handle when the pins are positioned in the sockets of the lid.

8. A refuse container according to claim 7, wherein the lid is flexibly removably from and mountable on the handle ends.

9. A refuse container according to claim 8, wherein the lid includes a depending peripheral skirt configured to surround and upper portion of the container body when the lid is closed.

10. A hinge according to claim 1, wherein the container body, the handle and the lid are rotationally molded.

11. A hinge according to claim 10, wherein the container body, the handle and the lid are rotationally molded from high-density, cross-linkable polyethylene.

12. A refuse container according to claim 7, wherein the container body, the handle, and the lid are rotationally molded.

13. A refuse container according to claim 12, wherein the container body, the handle, and the lid are rotationally molded from high-density, cross-linkable polyethylene.

* * * * *